US005857842A

United States Patent [19]

Sheehan

[11] Patent Number: 5,857,842

[45] Date of Patent: Jan. 12, 1999

[54] SEAMLESS PUMP WITH COAXIAL MAGNETIC COUPLING INCLUDING STATOR AND ROTOR

[76] Inventor: Kevin Sheehan, 505 Reita St., Ballston Spa, N.Y. 12020

[21] Appl. No.: 876,178

[22] Filed: Jun. 16, 1997

[51] Int. Cl.[6] ..... F04B 17/00

[52] U.S. Cl. ..... 417/420; 417/203; 417/410.4; 417/372; 418/48

[58] Field of Search ..... 417/420, 410.3, 417/410.4, 372, 373, 355, 203; 418/48, 161

[56] References Cited

U.S. PATENT DOCUMENTS

| | | | |
|---|---|---|---|
| 3,216,768 | 11/1965 | Soeding et al. | 418/48 |
| 5,482,432 | 1/1996 | Paliwoda et al. | 417/423.12 |
| 5,505,594 | 4/1996 | Sheehan | 417/420 |

FOREIGN PATENT DOCUMENTS

| | | | |
|---|---|---|---|
| 3045-146 | 7/1982 | Germany | 417/373 |

*Primary Examiner*—Charles G. Freay
*Assistant Examiner*—Cheryl J. Tyler
*Attorney, Agent, or Firm*—Schmeiser, Olsen & Watts

[57] ABSTRACT

A seamless pump is disclosed which includes a pump casing that houses a stator and a rotor. The stator and rotor provide enhanced pumping action in the seamless pump. The stator surrounds at least a portion of the rotor. A rotatable housing surrounds at least a portion of the pump casing and is operatively connected to the motor. A plurality of first magnets are located about an interior surface of the housing and are rotatable therewithin and a plurality of second magnets are operatively connected to and rotatable with the impeller. A seal isolates the second magnets from material being pumped by the pump. A cooling jacket may be used to cool the pump.

15 Claims, 2 Drawing Sheets

SEAMLESS PUMP WITH COAXIAL MAGNETIC COUPLING INCLUDING STATOR AND ROTOR

FIELD OF THE INVENTION

The invention is in the field of pumps. More particularly, the invention is a seamless pump that employs a magnetic coupling to drive a rotor against a stationary stator. The pump includes a structure for a cooling jacket.

BACKGROUND OF THE INVENTION

In an effort to prevent leakage of hazardous fluids from piping systems, the use of seamless pumps has become more common. While pumps of this type may employ seals at noncritical locations, the pump's primary characteristic is that a shaft seal is not required. The pump's rotor rotates by an apparatus that does not penetrate the piping system. In this manner, a primary site for leakage is avoided. This is particularly important in applications such as the pumping of hazardous waste (e.g., nuclear) material.

A typical seamless pump makes use of a magnetic coupling to drive the rotor. An example of this type of pump is provided by Zozulin in U.S. Pat. No. 2,827,856. Disclosed in the patent is an axial flow pump in which a cylindrical impeller has exterior magnets that are magnetically coupled to complementary magnets located outside of the pump casing. The exterior magnets are secured to a housing that rotates about the pump casing through the use of a pulley and belt system coupled to a motor. It should be noted that in the Zozulin reference, bushings having end-located seals are positioned at each end of the impeller to support the impeller and to seal its outer surface from the fluid being pumped.

Related art seamless pumps, while avoiding the shaft seal problems experienced by more conventional pumps, still suffer a number of problems. The pumps typically employ a complicated structure of bearings and/or bushings and/or seals to support the impeller. In addition, various seals are employed to either seal the impeller's outer surface from the fluid being pumped or to route the pumped fluid about the impeller for cooling purposes. This makes the units expensive to manufacture and difficult to maintain. The complexity of the related art units also adversely affects their durability and expected life-span. Another difficulty of the related art pumps is short life due to abrasive wear on the impeller.

One solution to the problems of these pumps is the pump disclosed in U.S. Pat. No. 5,505,594 to Sheehan. This device includes a pump that employs a magnetic coupling to connect the motor to the impeller. The pump includes structure for supporting the impeller and facilitating pump maintenance. A difficulty of this device, however, is flow without pulsation or variations of velocity or volume is disadvantageously created. Another difficulty is providing adequate pumping action. Another disadvantage is the ability to cool the pump. Thus, a need exists for a seamless pump that provides flow without pulsations or variations of velocity and provides adequate pumping action, and provides the ability to cool the pump.

SUMMARY OF THE INVENTION

The invention is a seamless pump that employs a magnetic coupling between the rotor and stator, and a rotatable housing located exterior to the pump casing. The invention makes use of a cooling jacket to cool the pump. In particular, the present invention includes a pump having a motor, a pump casing that houses a stator and a rotor, the stator surrounding at least a portion of the rotor, a rotatable housing surrounding at least a portion of the pump casing and operatively connected to the motor, a plurality of first magnets located about an interior surface of the housing and rotatable therewithin, a plurality of second magnets operatively connected to and rotatable with the impeller. Furthermore, this invention includes a pump comprising: a motor, a pump casing that houses a rotatable impeller, a rotatable housing surrounding at least a portion of the pump casing and operatively connected to the motor, a plurality of first magnets located about an interior surface of the housing and rotatable therewithin, a plurality of second magnets operatively connected to and rotatable with the impeller, and a seal for isolating the second magnets from material being pumped by the pump, and a coolant inlet and outlet for cooling the pump.

The motor portion of the pump which may be mounted to the pump casing, is preferably of the conventional type, and is connected by a belt and pulley system or alternatively a gear drive, to the rotatable housing. A plurality of axially-aligned magnets are spaced about the interior face of the housing. These magnets rotate with the housing and are magnetically coupled to a complementary set of magnets located within the casing of the pump.

The magnets located within the pump casing are secured to an outer portion of the pump's rotor. While the magnets rotate within the casing, a rotor and stator act on the fluid within the casing to thereby achieve the pumping function of the pump. An advantage of the present invention is the ability to increase wear life due to reduced abrasive wear on the rotor. The present invention includes a rotor (e.g., twisted rod) which contacts a stator. Another advantage is that flow is free from variations in velocity and volume. A further advantage is the ability to increase ease of flow of the pumped material. A further advantage is to cool the magnetic housing to cool the magnets through use of the pumped material or an outside coolant. Since the device may be used in hazardous materials applications, such as nuclear systems, it is desirable to keep the pumped material within the housing and use it as a coolant to prevent possible leakage. A further advantage would be to provide coolant from an outside source.

DETAILED DESCRIPTION OF THE DRAWINGS

Figure 1:
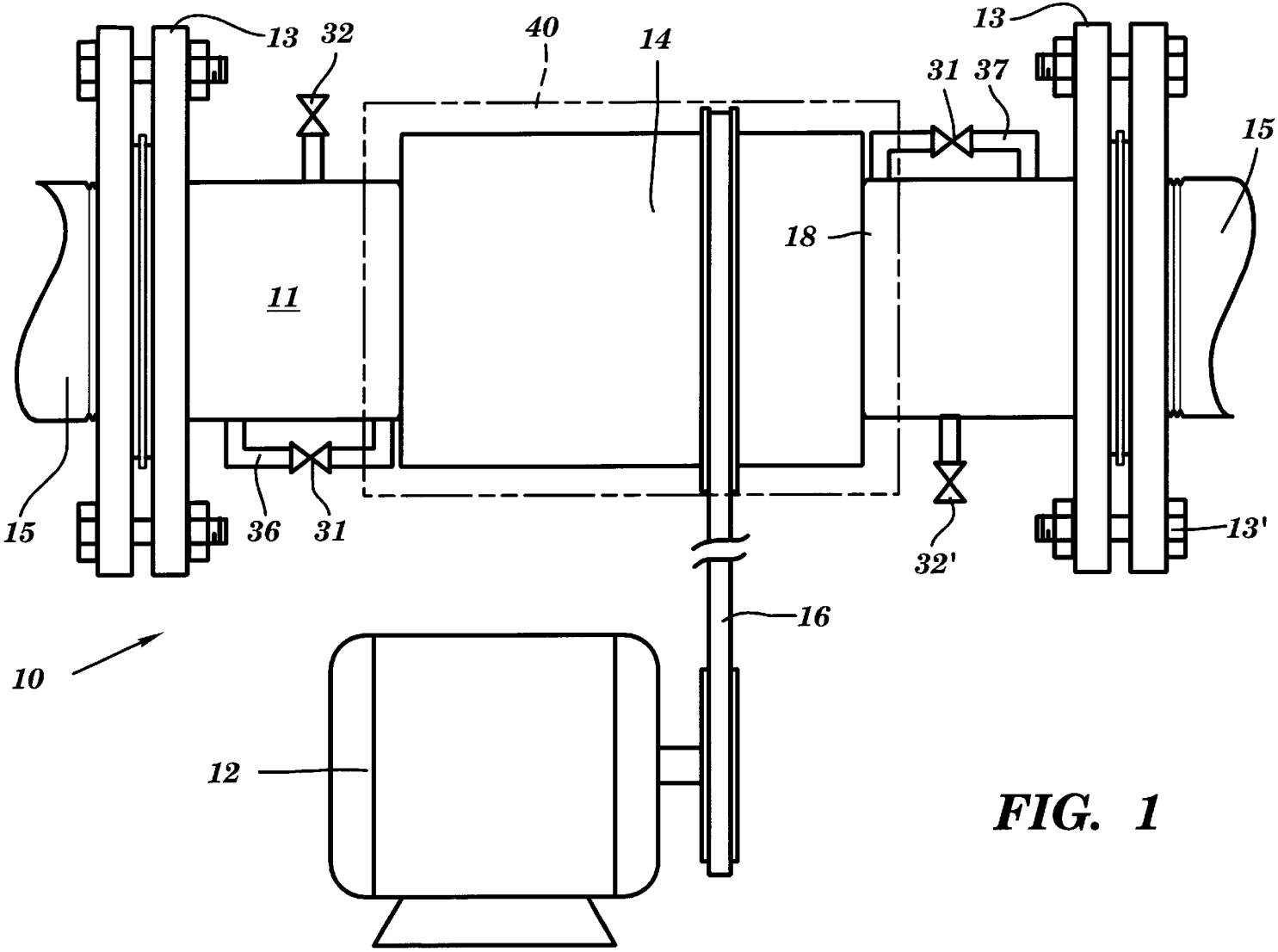
FIG. 1 is a generalized exterior view of a seamless pump in accordance with the invention.

Referring now to the drawings in greater detail, wherein like reference characters refer to like parts throughout the figures, there is shown by numeral 10 a seamless pump in accordance with a preferred embodiment of the present invention.

In FIG. 1 a generalized view of the pump structure is provided. The device includes a pump casing 11, a motor 12 which is connected to a rotatable housing 14 by a belt drive 16. In addition to the belt drive 16 it is conceivable that other types of drive mechanisms may be used, such as gearing, to rotate the housing 14. The pump casing 11 includes a flange 13 which is connectable to a piping system 15 by connectors 13'. On the pump casing 11 is shown tapping lines 32 and 32' for an outlet of coolant from outside the system. Various types of coolants may be used for ingress and egress from the magnetic chamber such as ethylene glycol or the like. In addition a fluid coolant inlet 36 and fluid coolant outlet 37 are shown attached to the pump casing 11. The inlet line 36 and outlet line 37 each include a check valve 31. The inlet line 36 is used for ingress of pumped material in to the magnetic chamber and the outlet line 37 is used for egress of pumped material from the magnetic chamber. In addition to check valves, other types of valving systems may be used such as adjustable valves or metering orifaces.

Figure 2:
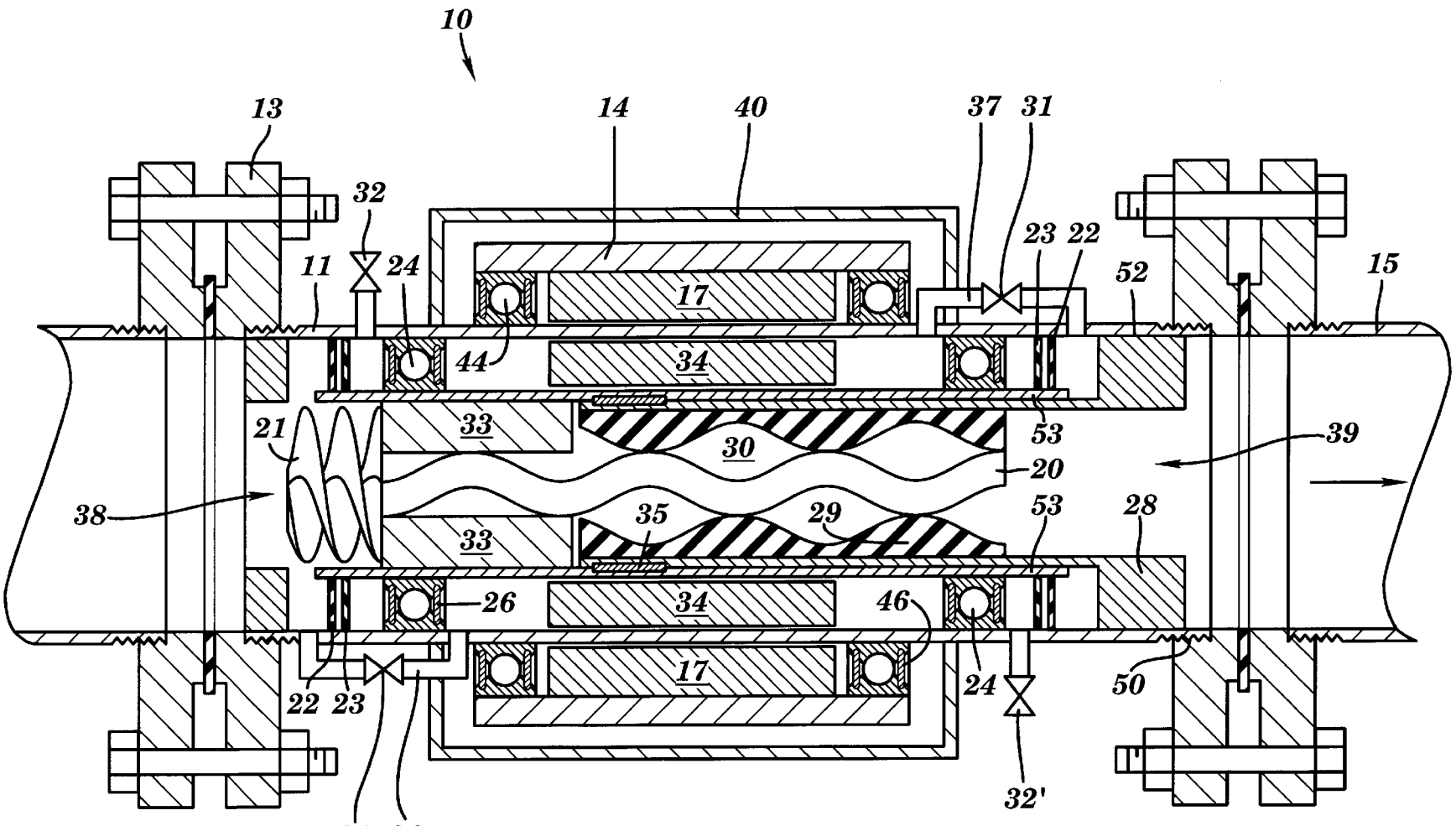
FIG. 2 is a cross-sectional view in the area of the pump casing of the pump shown in FIG. 1.

FIG. 2 shows a detailed, cross-sectional view in the area of the pump casing of a preferred embodiment of the present invention. In this view, first magnets 17 are shown mounted inside rotatable housing 14. First magnets 17 are coupled to rotate with the housing 14. The rotatable housing 14 is coupled to the exterior of the pump casing 11 through self lubricating bearings 44 (e.g., ball bearings) having fluid tight seals 46. The first magnets are magnetically coupled to inner magnets or second magnets 34. In other words, these magnets are aligned such that when the magnets 17 rotate, they also magnetically influence the second magnets 34. The magnets 34 are contained within the pump casing 11 and are coupled to a rotor assembly 20, 21, 33, 53.

The rotor assembly 20, 21, 33, 53 is positioned for pumping fluid from the fluid suction end 38 to the discharge end 39 of the pump 10. The rotor assembly has on a first end thereof an auger 21 that is fixed rotationally with the auger impeller housing 33 and the housing 33 is fixed rotationally with rotating member 53. The rotor assembly is supported within the pump casing 11 by bearings 24, 26, e.g., circular raceway-ball bearings, on the rotating member 53 and is forced ro rotate under the influence of the first magnets 34 fixed to the rotating member 53.

The pump also includes a stationary housing 28 and stator 29 positioned within the pump casing 11. The stator 29 includes a an undulated progressive cavity 30 which enhances fluid flow through the pump 10. The stationary housing 28 and stator 29 are interposed between the rotating member 53 and rotor 20 of the rotor assembly. A bearing 35 is positioned between the stationary housing 28 and rotatable member 53 to facilitate rotation thereof. Tapping lines 32 and 32' are provided to permit the flow of coolant into and out of the magnetic housing. The coolant is sealed from the pump material by a stationary seal 22 and rotating seal 23 positioned proximate the suction end 38 and discharge end 39 of the pump 10. The stationary seal 22 is coupled to the housing 11 and the rotatable seal 23 is coupled to the rotatable member 53. In the preferred embodiment, all of the bearings are made of RULON, a low friction-plastic bushing, or similar low friction plastic bushing material. In addition, it is envisioned that any non-metallic low friction bearing may be used. Each bearing 24 is preferably sealed and is a ball bearing which is either self-lubricating or contains a quantity of lubricant. Alternatively, each bearing may include a grease fitting (not shown) that extends through the pump casing 11. It should be noted that when a grease fitting is employed, the shaft of the fitting would be nonremovable and, therefore complicated seal structure would not be required.

It should be noted that each end of the tubular pump casing includes a large opening on the inside diameter between the discharge end 39, and the pipe 15. The discharge end 39 has a diameter greater than that of the stationary housing 28. In this manner, the discharge end 39 allows easy and complete removal of the rotor and its entire support structure from the suction end of the casing when either end of the flanges 13 have been disconnected from the piping system 10. As shown in this embodiment, the rotor 20 includes an auger 21 for forcing material into the suction end 38 of the rotor chamber or cavity 30. As shown, the pump may also include a safety cover 40. The cover is preferably made of a rigid material and is used to isolate the housing and its associated bearings from inadvertent external contact.

It is to be noted that in all of the embodiments as disclosed, the design of the pump greatly facilitates maintenance of the components within the pump casing. In addition, since every component located within the casing is removable from either end of the pump, the pump can be located where only one of its ends is accessible. Furthermore, in addition to a stator with an undulated surface, other shapes are conceivable such as a cylindrical bore. Variations in rotors are also conceivable, e.g., auger-shaped and bladed (e.g. turbine-like).

The embodiments disclosed herein have been discussed with the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A pump comprising:

a motor;

a pump casing that houses a stator and a rotor assembly, wherein the rotor assembly surrounds at least a portion of the stator;

a rotatable housing surrounding at least a portion of the pump casing and operatively connected to the motor;

a first magnet located about an interior surface of the rotatable housing and rotatable therewithin; and a second magnet operatively connected to and rotatable with the rotor assembly.

2. The pump of claim 1, wherein the rotatable housing has an inner surface and an outer surface, said inner surface including a bearing thereon.

3. The pump of claim 1, wherein the stator includes an inner surface that is an undulated progressive cavity.

4. The pump of claim 1, wherein the rotor assembly includes a rotor coupled to an auger impeller housing and a rotatable member coupled to the auger impeller housing.

5. The pump of claim 4, wherein the rotor assembly has a bearing thereon functioning to support the rotor assembly within the pump casing.

6. The pump of claim 4, wherein the rotor includes a twisted rod portion.

7. The pump of claim 5, wherein the bearing includes a plurality of ball bearings captured within a circular raceway.

8. The pump of claim 7, wherein the rotor is sealed to the pump casing by a rotatable seal.

9. A pump comprising:

a motor;

a pump casing that houses a rotatable rotor assembly;

a rotatable housing surrounding at least a portion of the pump casing and operatively connected to the motor;

at least one first magnet located about an interior surface of the housing and rotatable therewithin;

at least one second magnet operatively connected to and rotatable with the rotor assembly;

a seal rotatable with the rotor assembly and in contact with the pump casing for isolating the at least one second magnet from material being pumped by the pump; and a coolant inlet and outlet for cooling the pump.

10. The pump of claim 9, wherein the coolant inlet is coupled proximate a suction end of the pump to provide pumped material into a chamber housing the at least one second magnet and the coolant outlet is coupled proximate a discharge end of the pump ti egress pumped material from the chamber.

11. The pump of claim 9, wherein the coolant inlet is attached to a source of coolant exterior the pump to provide coolant into a chamber housing, the at least one second magnet and the coolant outlet being attached to drain coolant exterior the pump to egress coolant from the chamber.

12. A pump comprising:

a motor;

a pump casing;

a first rotatable magnet operatively coupled to the motor and surrounding the pump casing;

a second rotatable magnet within the pump casing, the second rotatable magnet coupled to a rotor assembly, the rotor assembly including a rotor operatively coupled to a rotating member; and a stator within the pump casing which is interposed between the rotor and the rotating member.

13. The pump of claim 12, wherein the stator includes an undulated progressive cavity.

14. The pump of claim 13, wherein the rotor is a twisted rod rotor.

15. The pump of claim 12, wherein the rotor assembly further includes an auger impeller housing operatively connected between the rotor and the rotating member, the auger impeller housing coupled to an auger.

* * * * *